US009113502B2

(12) United States Patent
Anton Falcon et al.

(10) Patent No.: US 9,113,502 B2
(45) Date of Patent: Aug. 18, 2015

(54) COOK-TOP HAVING AT LEAST THREE HEATING ZONES

(75) Inventors: Daniel Anton Falcon, Saragossa (ES); José Miguel Burdio Pinilla, Saragossa (ES); Jose-Ramon Garcia Jimenez, Saragossa (ES); Sergio Llorente Gil, Saragossa (ES); Oscar Lucia Gil, Saragossa (ES); Fernando Monterde Aznar, Saragossa (ES); Diego Puyal Puente, Saragossa (ES)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 850 days.

(21) Appl. No.: 13/132,647

(22) PCT Filed: May 27, 2009

(86) PCT No.: PCT/EP2009/056475

§ 371 (c)(1),
(2), (4) Date: Jun. 3, 2011

(87) PCT Pub. No.: WO2010/069616

PCT Pub. Date: Jun. 24, 2010

(65) Prior Publication Data

US 2011/0240632 A1 Oct. 6, 2011

(30) Foreign Application Priority Data

Dec. 19, 2008 (ES) ..... 200803708

(51) Int. Cl.

| | |
|---|---|
| ***H05B 6/02*** | (2006.01) |
| ***H05B 6/12*** | (2006.01) |
| ***H05B 6/04*** | (2006.01) |
| ***H05B 6/06*** | (2006.01) |

(52) U.S. Cl.
CPC ..... *H05B 6/065* (2013.01); *H05B 6/04* (2013.01); *H05B 2213/03* (2013.01)

(58) Field of Classification Search
CPC ..... H05B 6/04; H05B 6/065; H05B 2213/03
USPC ..... 219/601, 622, 662, 664, 670, 624–627, 219/630, 635, 660–661, 671–672
See application file for complete search history.

(56) References Cited

U.S. PATENT DOCUMENTS 3,843,857 A * 10/1974 Cunningham ..... 219/622
3,949,183 A * 4/1976 Usami et al. ..... 219/622

(Continued)

FOREIGN PATENT DOCUMENTS

EP 0844807 A1 5/1998
EP 1361780 A1 1/2006

(Continued)

OTHER PUBLICATIONS

Machine translation of FR 2 839 604 A1.*

(Continued)

*Primary Examiner* — Dana Ross
*Assistant Examiner* — Lindsey C Teaters
(74) *Attorney, Agent, or Firm* — James E. Howard; Andre Pallapies

(57) ABSTRACT

A cook-top or hob includes multiple inductors and at least three heating zones which are operated by the inductors. A single power electronics subassembly supplies the inductors with heating current and includes a common rectifier which is operably connected to the inductors for rectifying an alternating current supplied by a single phase of a household electrical system.

19 Claims, 7 Drawing Sheets

(56) References Cited

U.S. PATENT DOCUMENTS

| | | | | |
|---|---|---|---|---|
| 4,112,287 | A | 9/1978 | Oates et al. | |
| 7,265,325 | B2 * | 9/2007 | Herzog | 219/633 |
| 2009/0057298 | A1 * | 3/2009 | Komma | 219/624 |
| 2009/0139980 | A1 | 6/2009 | Acero Acero et al. | |

FOREIGN PATENT DOCUMENTS

| | | | |
|---|---|---|---|
| EP | 0971562 | B1 | 11/2006 |
| EP | 1921897 | A1 | 5/2008 |
| FR | 2839604 | A1 | 11/2003 |
| WO | 2008078869 | A1 | 7/2008 |

OTHER PUBLICATIONS

Machine translation of EP 1 921 897 A1.*

International Search Report PCT/EP2009/056475.

National Search Report ES P200803708.

Report of Examination including National Search Report CN 200980151042.2 dated Dec. 20, 2012.

* cited by examiner

COOK-TOP HAVING AT LEAST THREE HEATING ZONES

BACKGROUND OF THE INVENTION

The invention relates to a hob having multiple inductors and having at least three heating zones which can be operated by the inductors.

An induction hob having inductor heating elements which are configured for operating at least three or four heating zones of the induction hob is known from EP 0 971 562 B1 . The induction hob comprises two power electronics subassemblies which, as is customary in the hob field, each comprise a rectifier for rectifying an alternating voltage supplied by a phase of a household electrical system. Hobs are normally connected to three-phase systems having thee independent phases, of which, in the case of hobs having three or four heating zones, two phases are tapped.

Particularly in the field of induction hobs, the breakthrough with the general public is being slowed by the comparatively high costs. A significant cost factor is that of the power electronics subassemblies which in the prior art are dimensioned such that each of the heating zones can be operated simultaneously at full nominal heat output for the heating zone. In practice, however, such high heat outputs are very rarely if ever needed simultaneously in all heating zones.

BRIEF SUMMARY OF THE INVENTION

The object of the invention is therefore, in particular, to reduce the manufacturing costs of a generic hob.

The invention relates to a hob having multiple inductors and at least three heating zones which can be operated by the inductors.

It is proposed that the inductors be supplied with heating currents by a single power electronics subassembly having a rectifier which is used jointly for the inductors for rectifying an alternating current supplied by a single phase of a household electrical system. This saves on the need for the second power electronics subassembly normally used in large induction hobs having three or four heating zones. The technical prejudice that the power generated from one phase of a household electrical system is sufficient for operating no more than two heating zones scarcely stands up to testing in practice. Since the full heat output of a heating zone is very rarely if ever required, the maximum power input from one phase, limited for example by the fuse protection of the household electrical system with 16 A at 220-230 V to 3520-3680 W, is in the overwhelming majority of cases quite adequate for operating a hob having three or four heating zones. In the infrequent cases in which all three or four heating zones come to be used simultaneously, full power is never as a rule simultaneously demanded in all the heating zones used. The potential cost savings which can be achieved by dispensing with one power electronics subassembly are not outweighed by dispensing with the facility, which is of little relevance in practice, to operate all four heating zones at full heat output. Particularly if the sum of the inductor nominal power outputs of all the inductors is greater than a nominal power output of the power electronics subassembly, cost savings can be made in the power electronics subassembly. Through intelligent power management, which is a further aspect of the invention, an adequate heat output can nonetheless generally be provided in each of the heating zones in the vast majority of cases.

The power electronics subassembly may comprise multiple boards, for example a single-layer board for the filter components and a four-layer or multi-layer board for the control electronics.

The sum of the inductor nominal power outputs of all the inductors may, in particular, be more than 1.3 times the nominal power output of the power electronics subassembly.

The advantages of the invention object make themselves felt in particular with regard to the induction hobs. Power electronics subassemblies of such induction hobs comprise costly inverters, the number and performance capability of which can be reduced by the inventive restriction of the nominal power output of the induction hob. The inverters are preferably integrated within the power electronics subassembly or mounted together with the rectifier on a shared board. Complex power management can be enabled by a switching device for connecting the inductors to one of the inverters. The switching device preferably connects in different switching positions at least one of the inductors to different inverters and/or connects at least one of the inductors in at least one switching position to multiple inverters. This makes it possible on the one hand to reduce the number of inverters necessary by enabling flexible use of the inverters, and on the other hand to focus the power of two inverters on one of the inductors, thereby resulting in highly diverse control options for the hob.

In particular, the heat outputs or heating currents of all the inverters can be concentrated on a single inductor if the switching device in at least one switching position connects this inductor to all the inverters simultaneously.

In a further development of the invention, it is proposed that the switching device comprise at least one semiconductor switch, in particular a triac switch, arranged between an inductor and an inverter. An output of a triac switch can be connected to two or more inductors which may be switched in parallel and/or two or more inverters which may be switched in parallel. By this means, a switching device having a large number of possible switching positions can be realized in a simple and low-cost manner.

The invention can be used in particular in hobs having substantially square cover plates with an edge length of c. 60-80 cm.

In a particularly advantageous embodiment of the invention, a regular power electronics subassembly, configured to connect to a phase of a three-phase household electrical system and having a nominal power output not exceeding 5400 W or a maximum current of 25 Amps can be used at 220 W or 230 W. This value enables an adequate heat output, but will not in the great majority of countries overload the domestic electrical systems. A further conceivable value would be a maximum power output of 4600 A.

The inventive hob is advantageously part of a series comprising at least two different hob models serving different price segments of the market. The two hob types are distinguished in particular by the number of power electronics subassemblies used and by the distribution of the heating currents generated by the power electronics subassemblies to the various inductors. While the distribution can be achieved by suitable software in a control unit, which actuates the switching unit, the hardware of the more costly hob differs from the hardware of the inventive hob in having at least one additional power electronics subassembly.

The inventive hob comprising only one power electronics subassembly therefore advantageously has free installation space for installing a further power electronics subassembly which can be connected to a further phase of the household electrical system. Further means for holding an additional power electronics subassembly, for example screw holes, lugs or such like, can be provided in the free installation space.

In this way, the hob can be upgraded in a simple manner and the different hob types can be realized without changing a hob housing or a mounting frame which holds the power electronics subassemblies.

In a particularly advantageous embodiment of the invention, the hob comprises multiple pre-assembled modules, each comprising multiple inductors. The modular construction makes it possible for the flexibility in the structural design of the hob to be further increased, and for the various modules and power electronics subassemblies to be used in a wide variety of possible hob types.

The invention can be used particularly advantageously in hobs having at least three or four heating zones for heating different cooking utensil elements. The term 'heating zone' in this context is also used to designate flexibly definable heating zones in so-called matrix hobs, in which, depending on a detected position and size of a cooking utensil element, the control unit groups together various inductors into heating zones. The hob preferably comprises more than three simultaneously operable and flexibly definable heating zones. In this case, the control unit can be designed to operate three or more such heating zones simultaneously, and to do so in particular in such a way that the user can choose the desired heat outputs of the different heating zones independently of one another.

In the unlikely event that the user attempt to choose via a user interface heat outputs which in total exceed the nominal power output of the power electronics subassembly, various steps can be taken. Either the heat outputs of the individual heating zones can be reduced in line with the ratio of the nominal power output to the sum of the desired heat outputs chosen by the user, or the heat output of the particular heating zone which was last activated or whose desired heat output or power level was last increased is limited to an available residual heat output. The residual heat output is the difference between the heat outputs currently being consumed by the other heating zones and the nominal power output of the power electronics subassembly. The user can also be informed about the fact that the sum of the desired heat outputs demanded exceeds the available heat output. This may, for example, be effected by means of a light element or by means of a display on a visual display. Alternatively or additionally, acoustic signals are also conceivable. It is proposed in particular that the hob comprise a display element for displaying a fraction of the nominal power output of the power electronics subassembly currently being demanded. The user can see from this when a power limit has been reached and gauge whether the heating of a further cooking utensil element, for example a pot or a pan, would overstrain the performance capability of the hob, and would lead to a reduction of the heat output of the other heating zones as a result of any necessary redistribution of the heat output.

The fraction of the nominal power output may for example be indicated as a percentage value. This may be effected for example on a display or by light elements on a linear scale.

BRIEF DESCRIPTION OF THE DRAWINGS

Further advantages will emerge from the description of the drawings hereinbelow. Exemplary embodiments of the invention are shown in the drawings. The drawings, the description and the claims contain numerous features in combination. Persons skilled in the art will usefully also consider the features individually and group them into further useful combinations.

DETAILED DESCRIPTION OF EXEMPLARY EMBODIMENTS OF THE PRESENT INVENTION

Figure 1:
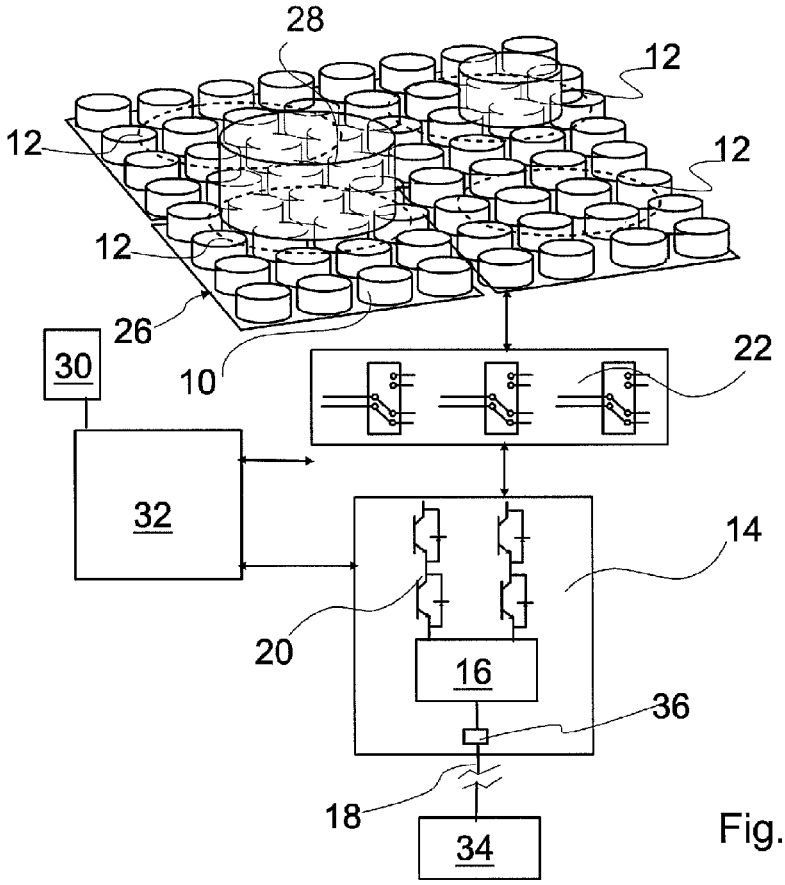
FIG. 1 shows an induction hob having four heating zones, a switching device and a power electronics subassembly.

FIG. 1 shows an induction hob having a matrix of inductors 10 which each comprise an induction coil and an inductor support made of aluminum. Four of these inductors 10 respectively are grouped into a pre-assembled module 26. The induction hob comprises four such modules 26 which are identical in construction. In alternative embodiments of the invention, each of the modules 26 comprises just one inductor.

The hob is substantially square with an edge length of c. 60 cm, and the inductors 10 are covered by a square cover plate (not shown), on which cooking utensil elements 28 such as, for example, pots and pans can be placed. The hob comprises a control unit 32, a single power electronics subassembly 14 having two inverters 20 and a switching device 22 via which a connection between the inverters 20 and the inductors 10 can be established or interrupted.

Via the switching device 22, each of the inductors 10 can be connected to multiple inverters 20 and each of the inverters 20 to multiple inductors 10, depending on the switching position of the switching device 22. It is also possible for multiple inverters 20 to be switched in parallel and simultaneously connected to a single inductor 10 so as to increase a heat output of said inductor. In different embodiments of the invention, this switching device 22 connects either each inverter 20 to each inductor 10 or each of the inverters 20 to a subset of the inductors 10.

Via a control line, the control unit 32 can both adjust a frequency of an alternating current generated by the inverters 20 and vary an amplitude of this alternating current. The variation of the amplitude is effected by pulse-width-modulated activation of the inverters 20 and by varying pulse widths of a gate input signal, generated by the control unit 32, of insulated-gate bipolar transistors (IGBTs) of the inverters 20.

The switching device 22 comprises a complex system of relays and/or semiconductor switches 24, in particular triac switches (FIG. 3) which each have inputs for control signals generated by the control unit 32, it being possible to change the switching position of the switching device 22 with the aid of these control signals.

The power electronics subassembly comprises furthermore a rectifier 16 which is connected to a phase 18 of a household electrical system 34. The household electrical system 34 supplies a three-phase alternating current with an amplitude of 22-230 V and is limited by means of a household fuse to a maximum current of 16 A. The power electronics subassembly can therefore achieve a maximum output of c. 3.5-3.7 kW. In alternative embodiments of the invention in which the household electrical system 34 supplies a maximum of 25 A, a nominal power output of the power electronics subassemblies is c. 4.5 kW.

Figure 2:
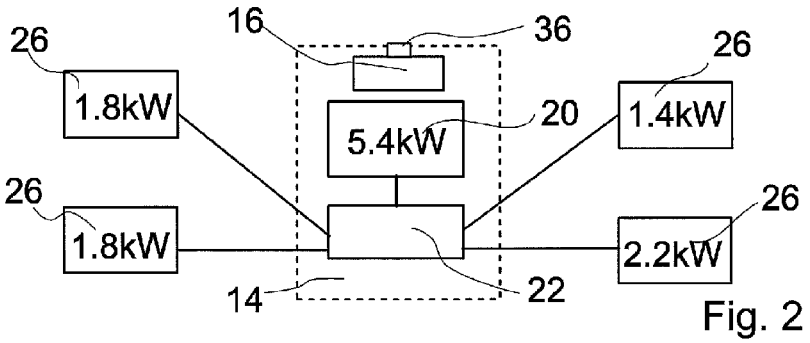
FIG. 2 shows a block diagram of an inventive hob having four heating zones, multiple inverters and a switching device.

FIG. 2 shows a block diagram of the inventive hob according to an alternative embodiment of the invention, in which the modules 26 each have an inductor 10. The four modules 26 each comprise inductors with a nominal power output of 2×1.8 kW, 1.4 kW and 2.2 kW, resulting in an overall nominal power output for the hob of 7.2 kW. The inductors 10 may comprise separate inductor supports or inductor supports used jointly by two inductors.

Each of the modules 26 can operate a heating zone 12 of the hob. The control unit 32, which detects the cooking utensil elements 28 placed on the hob, groups the inductors arranged beneath a base of the cooking utensil element 28 into a flexibly definable heating zone 12. The individual heating zones 12 and the modules 26 may be limited or comprise inductors 10 from various modules 26.

In the exemplary embodiment shown in FIG. 2, the power electronics subassembly 14 comprises the inverters 20 and the switching device 22, which according to the embodiment is integrated in the power electronics subassembly 14. All the elements of the power electronics subassembly 14 are mounted on a shared board which comprises a terminal 16 for connecting a phase 18 of the household electrical system 34 and a further terminal (not shown) for connecting a zero potential of the household electrical system 34.

In order to prevent an audible and disturbing intermodulation hum caused by the operation of adjacent inductors 10 at similar frequencies or the operation of inverters 20 with shared supply or control lines, the control unit 32 operates the inverters 20 simultaneously only at frequencies which are either the same or differ by at least 17 kHz. Since the different modules 26 of the hob are mechanically to a large extent independent, the control unit 32 uses this strategy to prevent the intermodulation hum only when the heating zones 12 concerned comprise inductors 10 of the same module 26. If the heating zones 12 are composed of inductors from different modules 26, the frequencies of the heating current with which the heating zones 12 are operated, can be varied independently of one another.

Figure 3:
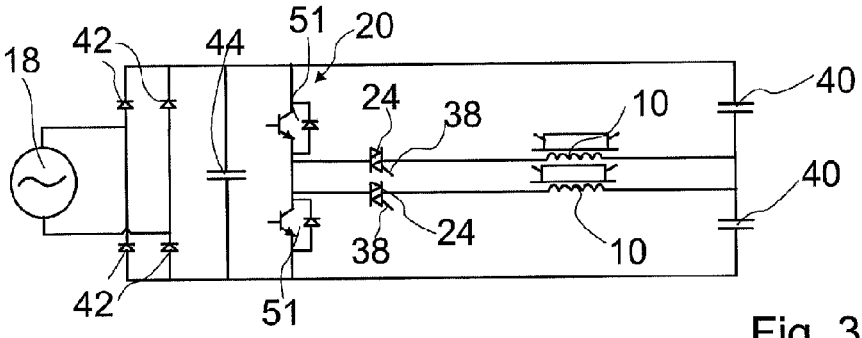
FIG. 3 shows a schematic representation relating to the topology of inverters of a power electronics subassembly according to the invention.

FIG. 3 shows a further schematic representation of the structure of the hob according to FIGS. 1 and 2. The switching device comprises two semiconductor switches 24 with terminals 38 for control lines in the control unit 32. In possible exemplary embodiments, IGBTs with diodes, triacs or thyristors can be used as semiconductor switches 24. Conventional electromechanical relays can also be used in place of the semiconductor switches 24. The inductors 10, of which for the sake of simplicity only two are shown, are switched in parallel and a capacitor 40 is assigned to each of the inductors 10, the capacitor forming together with the respective inductor 10 a resonant circuit. FIG. 3 also shows an inverter 20 which is configured in a half-bridge topology composed of two IGBTs 52. A plurality of rectifier diodes 42 of the rectifier 16 and a damping capacitor 44 are arranged between the inverter 20 and the phase 18 of the household electrical system 34. An EMC filter used jointly for all the heating zones is not shown.

Figure 4:
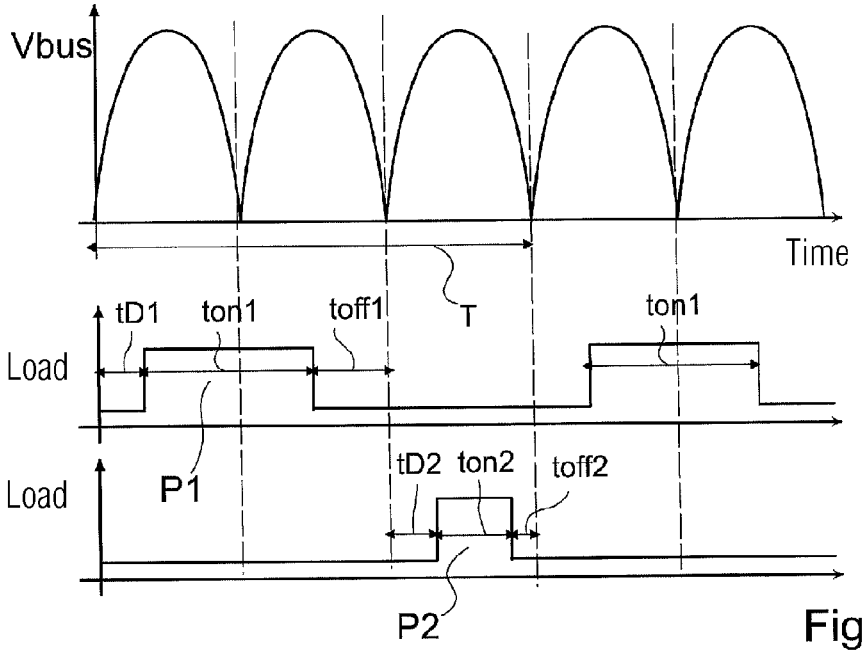
FIG. 4 shows a schematic representation relating to a power management system for the simultaneous supply of two heating zones, the activation phases of different heating zones being synchronized by means of zero settings of a control voltage.
Figure 5:
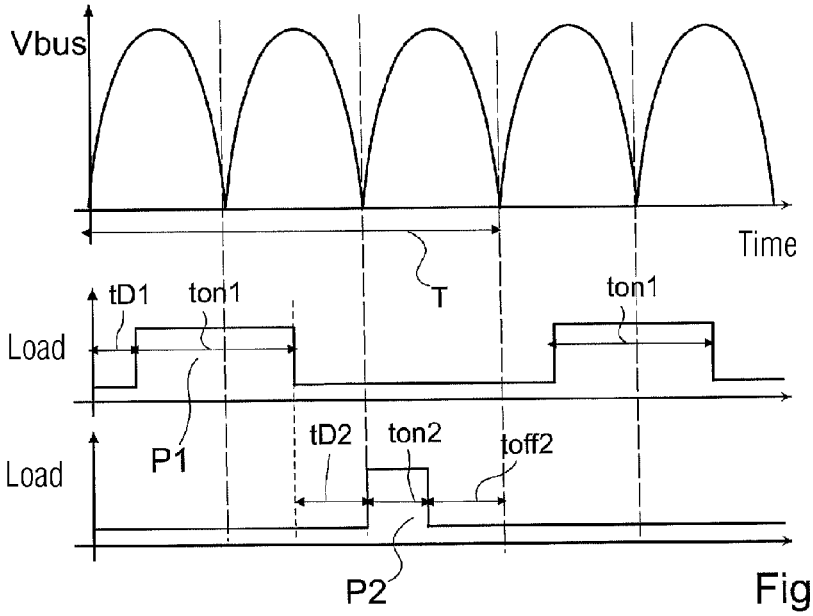
FIG. 5 shows a schematic representation relating to a power management system for the simultaneous supply of two heating zones, the activation phases of different heating zones being synchronized by means of the recording of an interval between the activation phases.

If multiple heating zones 12 have to be operated by a single inverter 20, a time-division multiplexing control method of the type shown in FIGS. 4 and 5 can be used. To make them easier to understand, the examples in FIGS. 4 and 5 are restricted to two heating zones 12 and to a control period T with a length of three half-cycles of the supply voltage. FIG. 4 shows the case of a non-complementary multiplexing method and FIG. 5 shows the case of a complementary multiplexing method. The advantage of the complementary multiplexing method is that multiple inductors 10 can be operated during the same supply voltage half-cycle.

A key aspect is that for each inductor 10 the number of half-cycles within a control period T during which this inductor 10 is operated is uneven. Flicker standards can in this way be complied with.

In exemplary embodiments in which a number of actively operated heating zones 12 is greater than a number of inverters 20 in the power electronics subassembly 14 or in which, for other reasons (for example because of an incomplete connection of the inverters 20 to the inductors 10 or the switching device 22), multiple heating zones 12 have to be operated by the same inverter 20, the control unit 32 uses a model shown in FIG. 4 for power management.

A synchronization AC voltage Vbus, which can be derived from the voltage generated by the rectifier 16, is used to trigger a control period T. A duration of the control period T is three half-cycles of the synchronization AC voltage Vbus. The control unit 32 activates the inductors of two different heating zones 12 in different activation phases, P1, P2, the duration ton1, ton2 of which and interval tD1, tD2 of which from zero crossings of the synchronization AC voltage Vbus is determined depending on a power level set for the heating zone 12 concerned. The activation phases P1, P2 are preferably chosen such that they do not overlap so as to prevent flicker. Within the control period T, a timing of the first activation phase P1 is determined by the interval tD1 from a zero crossing of the synchronization voltage Vbus, while the timing of the second activation phase P2 is determined by the interval tD2 from a second zero crossing of the synchronization voltage Vbus within the control period T.

FIG. 5 shows an alternative exemplary embodiment of the invention, in which the timing of the second activation phase P2 is determined by an interval tD2 from an end of the first activation phase P1. In comparison to the exemplary embodiment shown in FIG. 4, overlaps between the activation phases P1, P2 which would lead to flicker can be more reliably avoided in this way.

Figure 6:
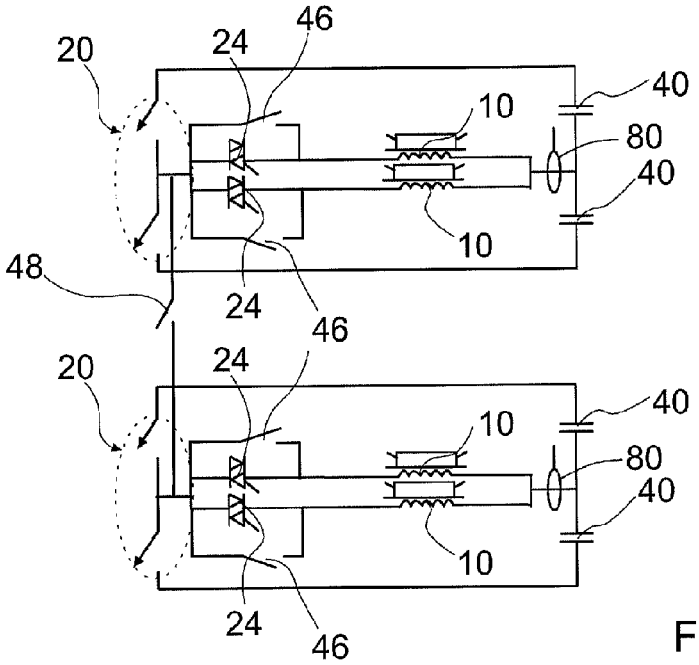
FIG. 6 shows a schematic representation of an interconnection of inductors and triac switches of a hob according to the invention.

FIG. 6 shows a schematic representation of a wiring of the inventive hob in which, in parallel with the semiconductor switches 24 of the various modules 26 of the hob, one relay 46 is provided in each case, by means of which the semiconductor switches 24 can be bridged if in an operating mode the inductors 10 as explained with the aid of FIG. 5 and FIG. 6 do not operate alternately, rather the inverters 20 supply the corresponding inductor 10 with heating current continuously. Furthermore, the switching device 22 comprises a booster relay by means of which an inverter 20 assigned principally to a first module can be connected to a second module such that the inductors 10 of the modules 26 can be supplied simultaneously by multiple inverters 20 of different modules 26. The total current flowing through the inductors 10 is measured with an ammeter 80.

Figure 7:
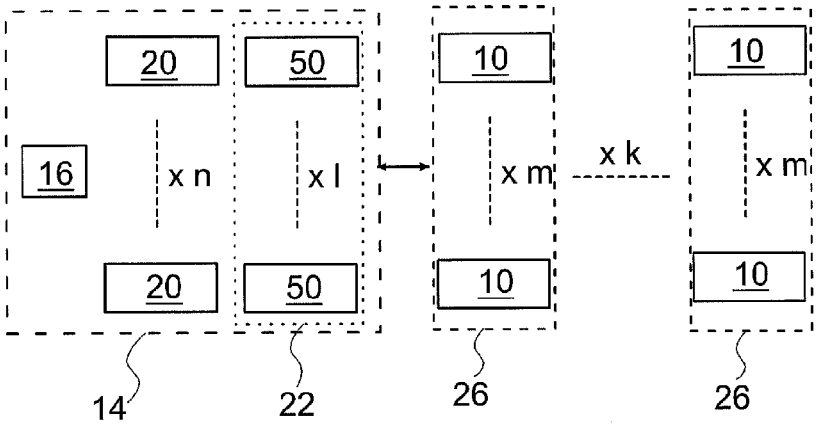
FIG. 7 shows a topology of a hob according to the invention, having multiple pre-assembled modules, each comprising groups of multiple inductors.

FIG. 7 shows a generalized block diagram of an inventive hob, in which k modules 26, each having m inductors 10, are supplied by a single power electronics subassembly 14 having n inverters 20 and 1 switching elements 50 of the switching device 22. The switching device 22 is grouped together with the rectifier 16 and the inverters 20 to form the power electronics subassembly 14. The inverters 20 have overall or in sum a nominal power output of 4.6 kW and the sum of the nominal power outputs of the inductors 10 is 7.2 kW. The nominal power output of the power electronics subassembly 14 depends on the parameters of the local household electrical system. At 230V and 20 A, this is 4.6 kW, at other current values, which can be 16 A, 20 A, 25 A or 32 A depending on the country, other values are produced.

Figure 8:
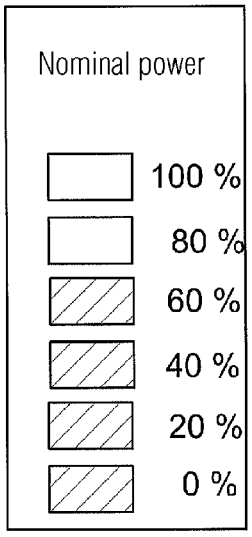
FIG. 8 shows a display element for displaying an available fraction of a nominal power output of the power electronics subassembly of a hob according to the invention.

FIG. 8 shows schematically a display element 30 arranged in a transparent area of the cover plate of the hob, which display element displays a fraction of the currently demanded nominal power output of the power electronics subassembly 14 as a percentage. The user can in this way see whether more power to increase a heat output of one of the heating zones 12 is available and/or whether still further heat output for heating a further cooking utensil element in a further heating zone 12 can be provided. If the display element 30 displays 100%, the nominal power output of the power electronics subassembly 14 is exhausted. The display element 30 is composed of a serigraph on the rear side of the cover plate and a number of light-emitting diodes which are switched on and off by the control unit 32 depending on the power currently being consumed.

If the user wishes to increase further the heat output of one of the heating zones 12 via a user interface (not shown here), he will be warned optically, for example via a message on a display or by a flashing of the display element 30. The control unit 32 then distributes the available power in accordance with the ratios of the power levels set for the heating zones 12 over the various heating zones. To do this, the control unit 32 may, for example, use the power management described in connection with FIGS. 4 and 5.

Figure 9:
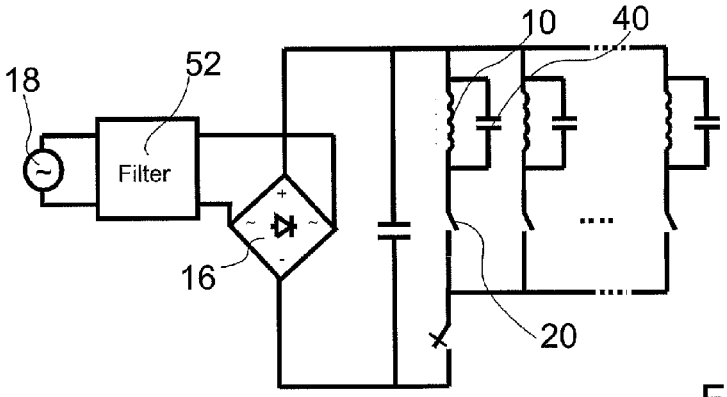
FIG. 9 shows a topology of an induction hob having single-switch inverters, according to a further embodiment of the invention.

FIG. 9 shows schematically the structure of an induction hob having multiple inductors 10 switched in parallel, which inductors are operated via an inverter 20 consisting of just a single semiconductor switch. Each of the inductors 10 is connected in series with an inverter 20. A capacitor 40 is arranged in parallel with the inductor 10, said capacitor supplementing the inductor 10 to form a closed resonant circuit. The hob is connected to a single phase 18 of the household electrical system, from which phase an input current for a rectifier 16 is drawn. A filter circuit 52 is arranged between the rectifier 16 and the phase 18. The filter circuit 52 eliminates high-frequency noise and is substantially a low-pass filter.

Figure 10:
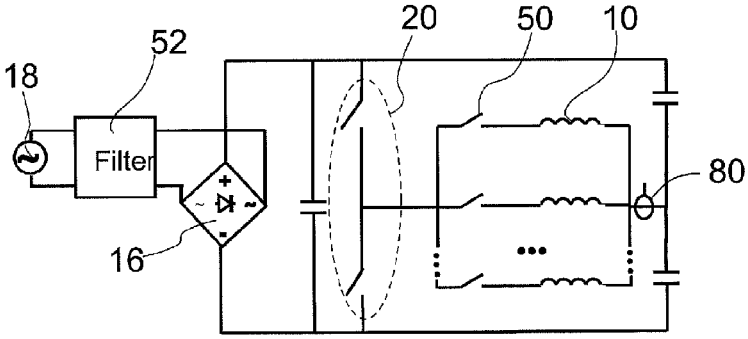
FIG. 10 shows a topology of an induction hob having multiple inductors which can be operated in parallel by a half-bridge inverter, according to a further embodiment of the invention.

FIG. 10 shows a further alternative embodiment of the invention having multiple inductors 10 which can be connected in parallel by means of switching elements 50 and which are connected to a half-bridge inverter 20 and can be operated using a time-division multiplexing method. Multiple inductors 10 can be operated simultaneously by means of the inverter 20, the maximum power output of the inverter 20 having to be designed accordingly.

Figure 11:
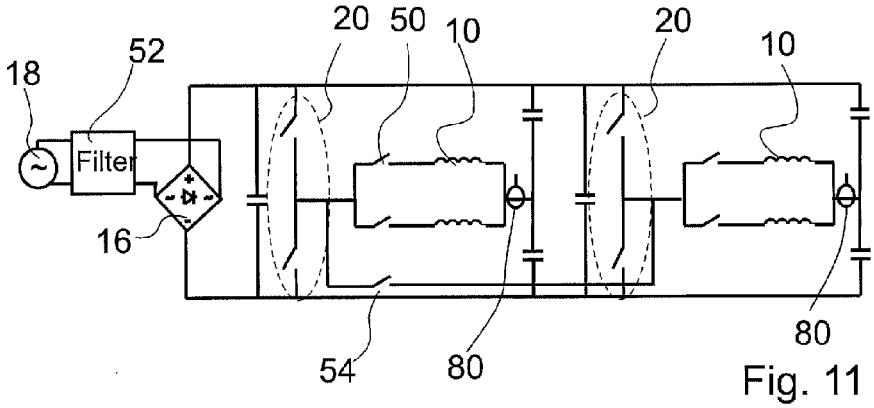
FIG. 11 shows a topology of an induction hob having two pairs of inductors which can be operated in parallel by a half-bridge inverter, according to a further embodiment of the invention.

FIG. 11 shows a further alternative exemplary embodiment in which two inductors in each case are connected to an inverter 20. By means of a switch 54, the two inverters 20 can be connected in parallel in order to increase the power output. The two inverters 20 are fed via a single rectifier 16.

Figure 12:
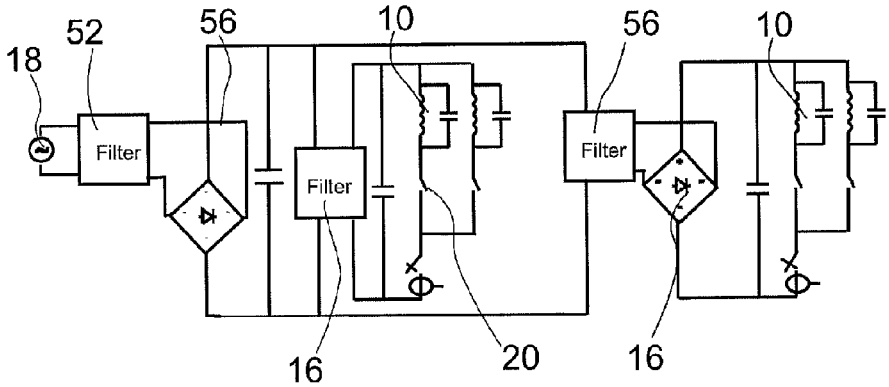
FIG. 12 shows a topology of an induction hob having two rectifiers and multiple filter circuits, according to a further embodiment of the invention.

FIG. 12 shows the structure of a further alternative hob having inductors 10 which are each operated via a single-switch inverter 20. The current from a single phase 18 of the household electrical system is rectified by two rectifiers 16, each assigned to a pair of inductors 10. A filter circuit 52 connected directly to the phase 18 of the household electrical system is supplemented by further filter circuits 56*a*, 56*b* which each low-pass filter the input current of one of the rectifiers 16.

The inverters 20 and the inductors 10 may, as shown in FIG. 2, have different nominal power outputs. The nominal power outputs are determined by the maximum power outputs of the semiconductor switches of the inverters 20 and of the passive components such as, for example, the damping capacitors and smoothing chokes. The semiconductor switches are preferably fashioned as IGBTs (insulated-gate bipolar transistors). Furthermore, when designing the inverters 20 and the inductors for a certain power output, consideration must also be given to cooling. A fan (not shown here) and a heat sink must be dimensioned to suit the maximum power output. The restriction of the power output is monitored by suitable firmware in microcontrollers of the hob. In the invention, semiconductor switching elements are preferably used for switching the inductors 10 on and off In this way, a time-division multiplexing method with time scales of a few milliseconds can be implemented. In comparison to the use of electromechanical relays, a noticeably discontinuous heat output can be avoided and there is no clicking when the relays switch.

Figure 13:
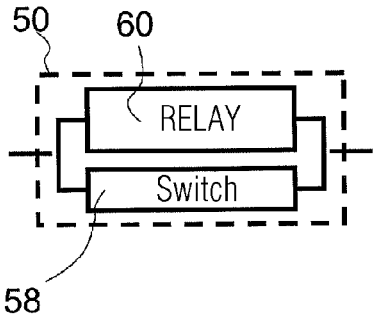
FIG. 13 shows a switching element for use in a hob according to the invention.

FIG. 13 shows an alternative embodiment of a switching element 50 for use in a hob according to the invention. A semiconductor switch 58, for example a triac or two IGBTs arranged in an antiparallel manner, is supplemented by an electromechanical relay 60 which is arranged in parallel and can be closed if high-frequency switchover procedures are not needed. In this way, power losses in the semiconductor switch 58 can be avoided in operating states in which the switching element 50 remains closed for longer.

Figure 14:
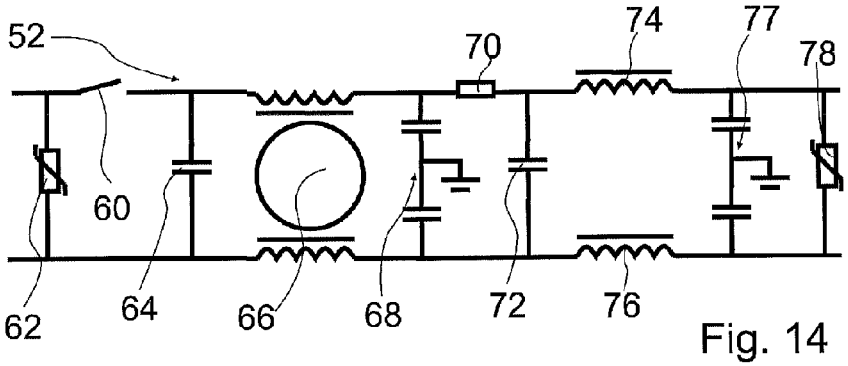
FIG. 14 shows a filter circuit for use in a hob according to the invention and FIG. 15 shows the topology of an induction hob, according to a further embodiment of the invention.
Figure 15:
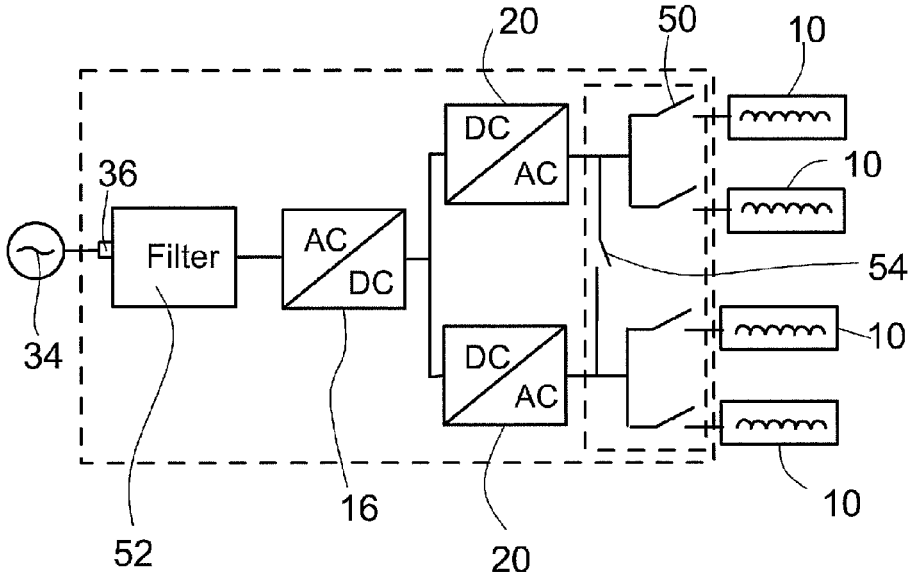

FIG. 14 shows a filter circuit 52 for use in an induction hob according to the invention. The filter circuit 52 comprises a varistor 6, a first damping capacitor 64, an input relay 60, a smoothing choke 66 for smoothing shared oscillations of the input lines, a further capacitor arrangement 68 for damping oscillations in the individual input lines, the two capacitors of the capacitor arrangement 68 each being earthed, a fuse 70, a further damping capacitor 72 and two differential smoothing chokes 74, 76 in the different lines. The filter circuit 52 is completed by a further capacitor arrangement 77 and by a further varistor 78.

FIG. 5 shows the topology of an induction hob according to a further embodiment of the invention. The current from the household electrical system 34 is filtered in a filter circuit 52 common to all the heating zones, inverters 20 and inductors 10, rectified in a rectifier 16 and fed to two inverters 20. Each of the inverters 20 can be connected via switching elements 50 and a switch 54 of a switching device 22 to each of the inductors 10. In particular, it is also possible to concentrate the total power output of the two inverters 20 onto a single inductor 10 by closing the switch 54 and closing just a single one of the switching elements 50.

REFERENCE CHARACTERS

10 inductor
12 heating zone
14 power electronics subassembly
16 rectifier
18 phase
20 inverter
22 switching device
24 semiconductor switch
26 module
28 cooking utensil element
30 display element
32 control unit
34 household electrical system
36 terminal
38 terminal
40 capacitor
42 rectifier diode
44 damping capacitor
46 relay
48 relay
50 switching element
51 IGBT
52 filter circuit
54 switch
56*a* filter circuit
56*b* filter circuit
58 semiconductor switch
60 relay
62 varistor
64 damping capacitor
66 smoothing choke
68 capaciptor arrangement
70 fuse
72 damping capacitor
74 smoothing choke
76 smoothing choke
77 capacitor arrangement
78 varistor
80 ammeter
T control period
P1 activation phase
P2 activation phase
Vbus synchronization ac voltage

The invention claimed is:

1. A hob, comprising:

a number of inductors arranged in a matrix, the number of inductors being more than three;

at least three heating zones which are operable by multiple subsets of the number of inductors; and a single power electronics subassembly that is configured to supply all of the number of inductors in the multiple subsets with heating current, the single power electronics subassembly comprising:

a common rectifier operably connected to the number of inductors for rectifying an alternating current supplied by a first single phase of a household electrical system; and a number of inverters for generating the heating current for operating all of the number of inductors, the number of inverters being less than the number of inductors.

2. The hob of claim 1, wherein a sum of inductor nominal power outputs from the single power electronics subassembly to all of the number of inductors is greater than a nominal power output of the single power electronics subassembly.

3. The hob of claim 1, further comprising a single switching device for connecting any of the number of inductors to at least one of the number of inverters in the single power electronics subassembly.

4. The hob of claim 3, wherein the single switching device connects at least one of the number of inductors in different switching positions to different ones of the number of inverters in the single power electronics subassembly.

5. The hob of claim 3, wherein the single switching device connects at least one of the number of inductors in at least one switching position to multiple ones of the number of inverters in the single power electronics subassembly.

6. The hob of claim 3, wherein the single switching device connects in at least one switching position a single one of the number of inductors to all of the number of inverters in the single power electronics subassembly simultaneously.

7. The hob of claim 3, wherein the single switching device comprises at least one bidirectional, bipolar semiconductor switch arranged between at least one of the number of inductors and at least one of the number of inverters.

8. The hob of claim 7, wherein the at least one bidirectional, bipolar semiconductor switch is a triac switch.

9. The hob of claim 7, further comprising an electromechanical relay arranged in parallel with the at least one bidirectional, bipolar semiconductor switch.

10. The hob of claim 1, wherein a nominal power output of the single power electronics subassembly does not exceed 5400 W.

11. The hob of claim 1, further comprising at least one other single power electronics subassembly arranged in an installation space for connection to a second single phase of the household electrical system, the second single phase of the household electrical system being a separate and distinct phase of the household electrical system from the first single phase of the household electrical system.

12. The hob of claim 1, further comprising a display element for displaying a fraction of a currently used nominal power output from the single power electronics subassembly.

13. The hob of claim 1, the single power electronics subassembly further comprising a single filter circuit for jointly filtering an input current for the number of inverters.

14. The hob of claim 1, further comprising a substantially square cover plate for covering the number of inductors, the cover plate having an edge length of between 60 cm and 80 cm.

15. A power electronics subassembly for controlling heating of a hob, comprising:

a number of inverters for generating a heating current to be selectively supplied to all of a number of inductors comprising a hob, the number of inductors being more than three, being organized into at least three heating zones, and being of a number greater than the number of inverters;

a common rectifier operably connected to the number of inductors for rectifying an alternating current supplied by a single phase of a household electrical system; and a single switching device for connecting any of the number of inductors to at least one of the number of inverters.

16. The power electronics subassembly of claim 15, wherein the single switching device connects at least one of the number of inductors in different switching positions to different ones of the number of inverters.

17. The power electronics subassembly of claim 15, wherein the single switching device connects at least one of the number of inductors in at least one switching position to multiple ones of the number of inverters.

18. The power electronics subassembly of claim 15, wherein the single switching device connects in at least one switching position a single one of the number of inductors to all of the number of inverters simultaneously.

19. A cooking appliance, comprising:

a cooktop unit including a number of inductors, the number of inductors being more than three and being arranged in at least three heating zones which are operable as multiple subsets of the number of inductors; and a single power electronics subassembly that is configured to supply all of the number of inductors in the multiple subsets with heating current, the single power electronics assembly having:

a common rectifier operably connected to the number of inductors for rectifying an alternating current supplied by a single phase of a household electrical system;

a number of inverters for generating the heating current for operating all of the number of inductors, the number of inverters being less than the number of inductors and a single switching device for connecting any of the number of inductors to at least one of the number of inverters.

* * * * *

UNITED STATES PATENT AND TRADEMARK OFFICE

CERTIFICATE OF CORRECTION

PATENT NO. : 9,113,502 B2
APPLICATION NO. : 13/132647
DATED : August 18, 2015
INVENTOR(S) : Daniel Anton Falcon et al.

It is certified that error appears in the above-identified patent and that said Letters Patent is hereby corrected as shown below:

On The Title Page, Item (73) should read:

(73) Assignee: BSH Hausgeraete GmbH, Munich (DE)

Signed and Sealed this
Twenty-ninth Day of March, 2016

Michelle K. Lee

Michelle K. Lee
*Director of the United States Patent and Trademark Office*